United States Patent [19]

Pozin

[11] 4,440,084

[45] Apr. 3, 1984

[54] METHOD OF ADJUSTMENT OF PRINTING MACHINE INKING DEVICE

[76] Inventor: Boris Pozin, 35-33 83rd St., Jackson Heights, N.Y. 11510

[21] Appl. No.: 379,099

[22] Filed: May 17, 1982

[51] Int. Cl.[3] ..... B41F 31/02

[52] U.S. Cl. ..... 101/365; 118/712; 118/713; 427/9

[58] Field of Search ..... 101/365, DIG. 24, 350; 118/712, 713; 427/9, 10; 356/421-424, 243; 116/230, DIG. 47; 33/137 R

[56] References Cited

U.S. PATENT DOCUMENTS

| | | | |
|---|---|---|---|
| 2,932,897 | 4/1960 | Huber | 33/137 R |
| 3,096,137 | 7/1963 | Silard | 356/421 X |
| 3,353,484 | 11/1967 | Koyak | 101/365 X |
| 3,995,958 | 12/1976 | Pfahl et al. | 101/365 X |
| 4,200,932 | 4/1980 | Schramm et al. | 101/365 X |

*Primary Examiner*—Edgar S. Burr
*Assistant Examiner*—Moshe I. Cohen
*Attorney, Agent, or Firm*—Ilya Zborovsky

[57] ABSTRACT

A colorless prospective color bars pattern is attached to a printing form, an ink is applied onto both of them, the densities of the thus produced color bars are measured at respective locations, and adjusting members arranged to adjust an ink supplying gap along an inking roller are displaced in correspondence with the measured densities at these locations.

4 Claims, 3 Drawing Figures

METHOD OF ADJUSTMENT OF PRINTING MACHINE INKING DEVICE

BACKGROUND OF THE INVENTION

The present invention relates to a method of ink supply adjustment in a printing machine inking device.

Inking devices of multi-color printing machines include an inking roller and an inking blade forming an elongated gap therebetween, and a plurality of adjusting members spaced from one another at a plurality of locations in direction of elongation of the gap and arranged to adjust the latter at the respective locations. The adjustment of the gap at the respective locations provides for required ink supply of a respective color at these locations. There are several methods of adjusting the ink supply at the respective locations of the gap by displacement of the inking blade relative to the inking roller. In accordance with one method a sample sheet is printed with color bars on it, densities of the thus produced color bars are determined at the respective locations by a densitometer, deviations from standard values of color densities are determined at each location, and then the adjusting members are displaced at the respective locations to act upon the inking blade so as to change the gap and thereby the ink supply at these locations. This method possesses a considerable disadvantage in the fact that it consumes a great amount of paper. In accordance with another method a printing plate is scanned before ink application to thereby adjust the gap by the respective displacement of the adjusting members and acting upon the respective parts of the inking blade so as to change the gap and thereby adjust the ink supply at these locations. This method possesses a considerable disadvantage in the fact that it requires extremely expensive equipment.

SUMMARY OF THE INVENTION

Accordingly, it is an object of the present invention to provide a method of adjustment of a printing machine ink-supplying device, which avoids the disadvantages of the prior art.

More particularly, it is an object of the present invention to provide a method of adjustment of a printing machine ink-supplying device which is simple, inexpensive and accurate.

In keeping with these objects and with others which will become apparent hereinafter, one feature of the present invention resides, briefly stated, in a method in which a colorless pattern of prospective color bars is applied on a printing plate, then ink is applied both on the printing plate and the pattern successively, whereupon color densities at a plurality of locations are measured on the thus produced color bars, and adjusting members of an inking device are displaced at the respective locations in accordance with determined color densities deviations at these locations.

When the method is performed in accordance with the present invention, it is easy, inexpensive and accurate.

The novel features of the present invention are set forth in particular in the appended claims. The invention itself will be best understood from the following description of a preferred embodiment which is accompanied by the drawing.

DESCRIPTION OF A PREFERRED EMBODIMENT

Figure 1:
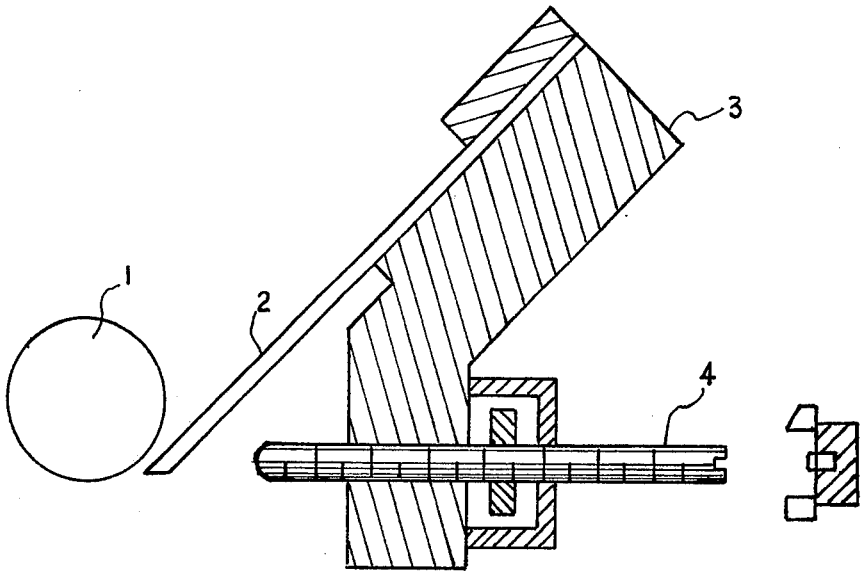
FIG. 1 is a view showing an inking device in accordance with a prior art.

An inking device of a multi-color printing machine has an inking roller 1 and an inking blade 2 extending over a substantially entire axial length of the inking roller and defining a gap therebetween. The inking blade 2 is fixed in a frame 3 and has an elastic edge which actually forms a gap together with the inking roller. A plurality of adjusting members 4 having an elongated screw and a disc-shaped abutment are arranged at a plurality of locations spaced from one another in direction of elongation of the gap. The adjusting members 4 are each individually displaceable in a support 5 attached to the frame between a front position and a rear position in which they abut against the frame or the support respectively. The front end of each adjusting member acts upon and displaces the inking blade 2 relative to the inking roller 1 at the respective locations so as to adjust the ink supply gap B at these locations. In the front position of the adjusting member the gap and thereby the ink supply is minimum, whereas in the rear position of the adjusting member the gap and thereby the ink supply is maximum (FIG. 1).

Figure 2:
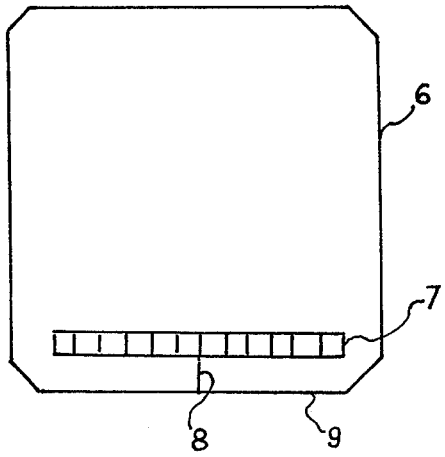
FIG. 2 is a view showing a printing plate with an attached colorless pattern of prospective color bars in accordance with the inventive method.
Figure 3:
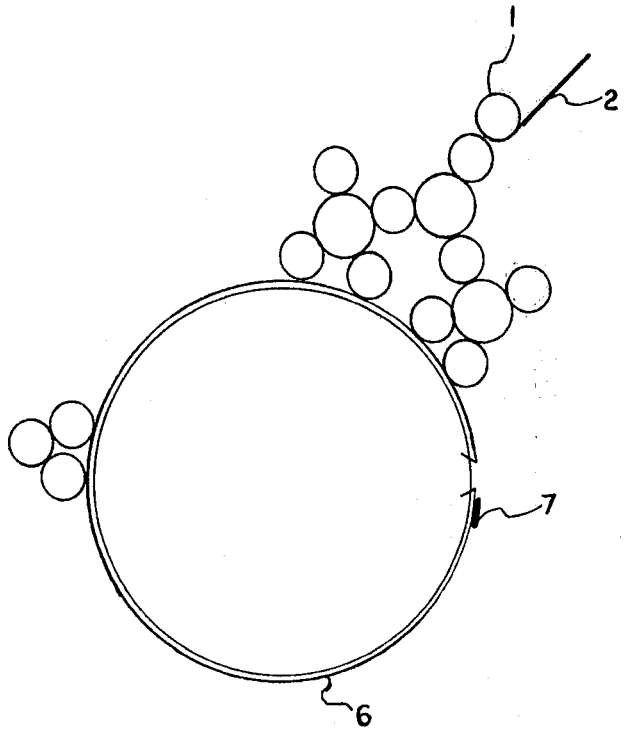
FIG. 3 is a view showing a part of a printing machine with the inventive color bar pattern attached to the pring plate.

The inventive method is performed for determining a required displacement of each adjusting member to provide a high quality multi-color printed article. In accordance with the method of the present invention a colorless pattern of prospective color bars 7 is attached to a printing plate 6, as can be seen from FIG. 2. The colorless pattern can be formed on a sensitive paper or plastic carrier. The carrier can have a sticky rear side protected before use by a protective layer peelable for attaching the carrier to the printing plate. The printing plate 6 and the carrier with the pattern have marks 8 which must be brought into coincidence for correction position of the pattern carrier on the printing plate. Each carrier has an identification mark for identifying a color for which it is provided.

Attachement of the pattern carrier 7 on the printing plate 6 is performed in a place accepted at a respective factory and in dependence upon a printing work type. As can be seen from FIG. 2, the pattern carrier 7 is arranged near the rear edge 9 of the printing plate 6. The pattern carrier can be offset forwardly from the rear edge. It also can be attached on printing elements of the printing plate since it occupies only an insignificant area.

The printing plate with the attached color bar pattern carrier is mounted in the printing machine and an inking system is activated. Ink is uniformly supplied through a plurality of rollers (In advance, the ink supply gap B in the inking device is adjusted to a certain value providing the uniform ink supply). After this damping water supply is actuated and ink is supplied onto the printing form without pressure. Then the printing machine is stopped. The printing plate 6 together with the color bar pattern 7 have received a certain amount of ink.

The color bar pattern carrier 7 is removed from the machine and the printing plate 6 and placed on a table for density analysis. Density measurements are performed on the thus produced color bars by densitometers at a plurality of locations corresponding to the locations of the adjusting members 4. Then deviations of the measured densities values from standard values are determined. The thus determined density deviations are converted into numerical values of displacements of the adjusting members 4. The respective adjusting members are displaced from their initial position by the thus calculated distances.

The invention is not limited to the details shown since various modifications and structural changes are possible without departing in any way from the spirit of the present invention.

What is desired to be protected by Letters Patent is set forth in the appended claims:

1. A method of adjustment of a multi-color printing machine with an ink supply gap formed between an inking roller and an inking blade and changeable at a plurality of locations by a plurality of adjusting members acting upon the inking blade at these locations, the method comprising the steps of forming a supply gap between an inking roller and an inking blade so that the supply gap is identical at all these locations;

providing a printing plate with a prospective image to be printed;

attaching a colorless pattern of a prospective color bar on a portion of the printing plate, the portion spaced from the image;

applying ink by inking means of a printing machine successively first on the prospective image and then onto the colorless bar pattern attached to the printing plate, by displacing the printing plate relative to the inking means;

measuring color densities of the thus produced color bar attached to the printing plate, at a plurality of color bar locations corresponding to the locations of the adjusting members;

determining deviations of the thus measured color densities of the color bar attached to the printing plate, from the standard values at the respective locations of the color bar; and actuating the respective adjusting members so as to displace the inking blade at the respective locations in correspondence with the thus determined color densities deviations of the color bar attached to the printing plate, so as to adjust the ink supply gap and thereby required ink supply at the respective locations.

2. A method as defined in claim 1, wherein said providing step includes providing a printing plate with a rear portion as considered in direction of movement of the printing plate during printing, said attaching step including attaching the colorless pattern of prospective color bars on the rear portion of the printing plate.

3. A method as defined in claim 1, wherein said attaching step includes forming the colorless pattern of the prospective color bars on a carrier and attaching said carrier to the printing plate.

4. A method of adjusting of a multi-color printing machine with an ink supply gap formed between an inking roller and an inking blade and changeable at a plurality of locations by a plurality of adjusting members acting upon the inking blade at these locations, the method comprising the steps of forming a supply gap between an inking roller and an inking blade so that the supply gap is identical at all these locations:

providing a printing plate with a prospective image to be printed;

attaching a colorless pattern of a prospective color bar on a portion of the printing plate, the portion spaced from the image;

applying ink by inking means of a printing machine successively first on the prospective image and then onto the colorless bar pattern attached to the printing plate, by displacing the printing plate relative to the inking means;

removing the thus-produced color bar from the printing plate;

measuring color densities of the color bar thus-produced on and removed from the printing plate, at a plurality of color bar locations corresponding to the locations of the adjusting members;

determining deviations of the thus-measured color densities of the color bar produced on and removed from the printing plate, from the standard values at the respective locations of the color bar; and actuating the respective adjusting members so as to displace the inking blade at the respective locations in correspondence with the thus-determined color densities deviations of the color bar produced on and removed from the printing plate, so as to adjust the ink supply at the respective locations.

* * * * *